US005875730A

United States Patent [19]

Erceg

[11] Patent Number: 5,875,730

[45] Date of Patent: Mar. 2, 1999

[54] DEVICE FOR ATTACHING PONTOON FORMS OF WATERCRAFT TO RIGID KEEL FORMS

[75] Inventor: Ivan Erceg, Auckland, New Zealand

[73] Assignee: Force Four USA Ltd., Hampden, Mass.

[21] Appl. No.: 958,177

[22] Filed: Oct. 27, 1997

[30] Foreign Application Priority Data

Mar. 12, 1997 [NZ] New Zealand ..... 314402

[51] Int. Cl.[6] ..... B63B 7/08

[52] U.S. Cl. ..... 114/345

[58] Field of Search ..... 114/345; 441/40

[56] References Cited

U.S. PATENT DOCUMENTS 5,522,338 6/1996 Eilert et al. ..... 114/345

5,584,260 12/1996 Hemphill ..... 114/345

*Primary Examiner*—Ed L. Swinehart

*Attorney, Agent, or Firm*—Fishman, Dionne, Cantor & Colburn

[57] ABSTRACT

A device for attaching pontoon forms of watercraft to rigid keels. The invention utilizes an elongate member attached to the keel. The elongate member includes an arcuate form having a surface that substantially conforms a portion of the surface of the pontoon. The elongate member also includes a channel which receives a lip extending radially from the pontoon. The interference between the channel and the lip prevent the pontoon from being radially removed from the elongate member. The surface of the arcuate form may include ridges.

15 Claims, 4 Drawing Sheets

DEVICE FOR ATTACHING PONTOON FORMS OF WATERCRAFT TO RIGID KEEL FORMS

BACKGROUND OF THE INVENTION

1. Field of the Invention

The present invention relates to devices for attaching pontoon forms of watercraft to rigid keel forms. Various devices and/or methods of attaching pontoons such as inflatable pontoons of inflatable rubber watercraft, to the rigid keel/planing surface (herein after referred to as keel) of the watercraft are known. Such include the use of adhesive to adhere a flap extending along the pontoons to the rigid keel.

2. Summary of the Invention

It is an object of the present invention to provide a mechanism for attaching pontoon forms of watercraft to rigid keel forms, which will at least provide the public with an alternative connection method.

Accordingly in a first aspect, the present invention comprises in an extruded, fabricated and/or roll formed elongate member to be interposed between a rigid keel form of a watercraft and a pontoon thereof, said member defining in cross-section, an arcuate form to substantially conform to at least part of the cross-sectional profile of an inflated or inflatable pontoon with which it is to nestle in use, a channel defining member with a profile adapted to slidably receive an extension e.g. a lip or lips (e.g. of a beaded flexible flange or the equivalent) extending along said pontoon and presented substantially radially from said pontoon yet hold against removal in a at least a direction radially to said pontoon, wherein said elongate member a) includes on that surface to nestle against said pontoon (when inflated), profiling which in use creates an interruption of any capillary or the like water displacing effect into said watercraft between said member and the pontoon and, b) presents a region for attachment by welding, adhesion or other interconnecting methods with said rigid keel form.

Preferably said elongate member is an extrusion and said region for attachment consists of an extension of the extrusion.

Preferably said channel defining member is positioned other than at an extremity of said arcuate form.

Preferably said arcuate form is longer on the side of the channel defining member inside said watercraft.

Preferably said channel, in cross sectional profile, extends substantially radially outwardly from said arcuate form.

Preferably said profiling consists of a plurality of ridges and/or grooves extending longitudinally along said extrusion.

Preferably said channel defining member has a slot of substantially circular cross-section to receive a corresponding area of circular cross-section in said lip, said slot located at the distal end of said channel away from said arcuate form.

In a further aspect the present invention consists in combination, a keel forming a rigid or a substantially rigid keel form for an inflatable craft and an extruded, fabricated or roll formed member as previously defined, said member being attached by appropriate mechanisms to said substantially rigid keel form so as to present outwardly of the sides periphery thereof said arcuate form.

Preferably said combination includes the pontoons and, optionally, also a transom.

And in still a further aspect the present invention consists in a watercraft comprising a pair of pontoon-like structures that (irrespective of the number of air-tight compartments contained therein) converge to a bow form, a substantially rigid keel form, optionally, a structure defining a transom and presented from said substantially rigid keel form in cross-section, an arcuate profile that substantially conforms at least in part with the cross-sectional profile of each inflated pontoon form when the pair of pontoon-like structures are inflated and nestles therewith on either side, wherein there is provided on said arcuate profile in cross section, to nestle against said pontoon-like structures, profiling that creates an interruption of any capillary or the like water displacing effect into said watercraft between said profiling and said pontoon(s). Preferably said arcuate profile is that of an extruded, fabricated and/or roll formed member of the present invention.

Preferably a channel extends along the arcuate profile in a position other than at an extremity of the arcuate profile, said channel also extending substantially radially outwardly from said arcuate profile, and adapted to slidably receive an extension, e.g. a lip or lips (e.g. of a beaded flexible flange or the equivalent) extending along said pontoon and present a substantially radially from said pontoon to hold against removal in at least a direction radially to said pontoon.

Preferably said profiling consists of a plurality of ridges extending longitudinally along the extruded fabricated and/or roll formed member.

Preferably said arcuate profile is extruded.

Preferably said channel defining member has a slot of substantially circular cross-section to receive a corresponding area of circular cross-section in said lip, said slot located at the distal end of said channel defining member away from said arcuate form.

Preferably said arcuate profile extends from transom to bow on each side of said keel to interconnect said keel to said pontoons.

In still a further aspect, the present invention consists in a method of attaching a pontoon of a watercraft to a substantially rigid keel form comprising, mating said pontoon with an extruded, fabricated or roll formed elongate member attached by welding, adhesion or other interconnecting methods to said substantially rigid keel form, and slidably engaging member outstanding from each pontoon in a channel formed by the section of said member to retain each pontoon when inflated at least substantially against an arcuate form of the section of said member, and wherein said member on said arcuate form which generally conforms to the shape of part of the periphery of its proximate pontoon in use having longitudinal or other profiling features (e.g. grooves and/or ridges, striations, waves, etc.) to reduce water progression upwardly between each pontoon and said member into the boat.

BRIEF DESCRIPTION OF THE DRAWINGS

The invention consists in the foregoing and also envisages constructions of which the following gives examples.

One preferred form of the present invention will now be described with reference to the accompanying drawings in which.

DISCLOSURE OF THE INVENTION

Figure 1:
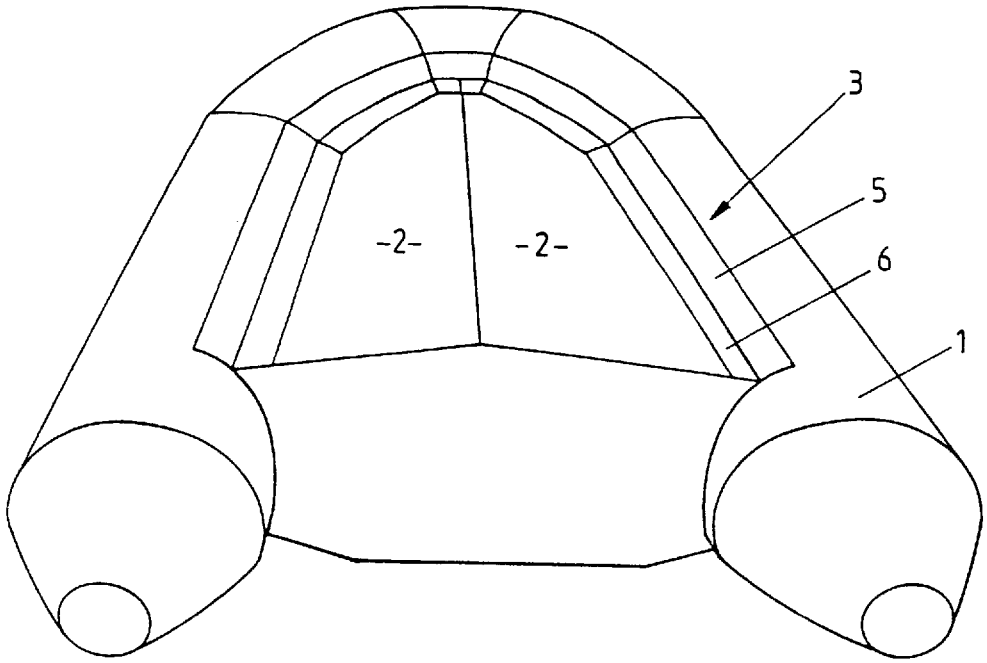
FIG. 1 is a bottom perspective view of a watercraft.

In the preferred form of the present invention, a water vessel such as an inflatable rubber boat as shown in FIG. 1 consists of a pontoon, or pontoons (1) which are secured to a substantially rigid keel (2) by an elongate member (3). Most commonly the pontoon/pontoons (1) are inflatable pontoons which are secured to a substantially rigid keel or planing surface (2).

Figure 2:
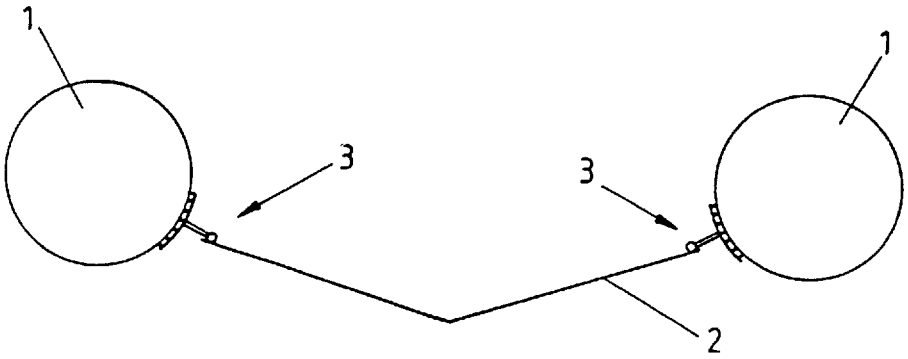
FIG. 2 is a cross-sectional view through a watercraft at a cross section substantially midships.
Figure 3:
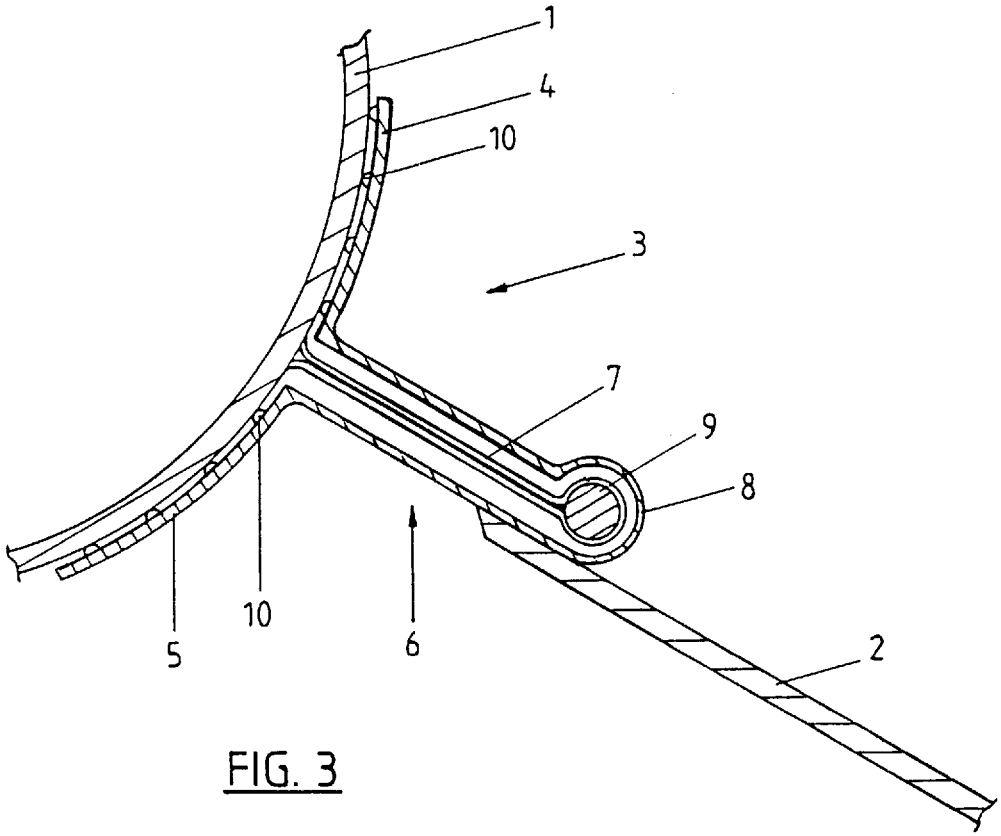
FIG. 3 is a part cross-sectional view through the elongate member, pontoon, and rigid keel.
Figure 4:
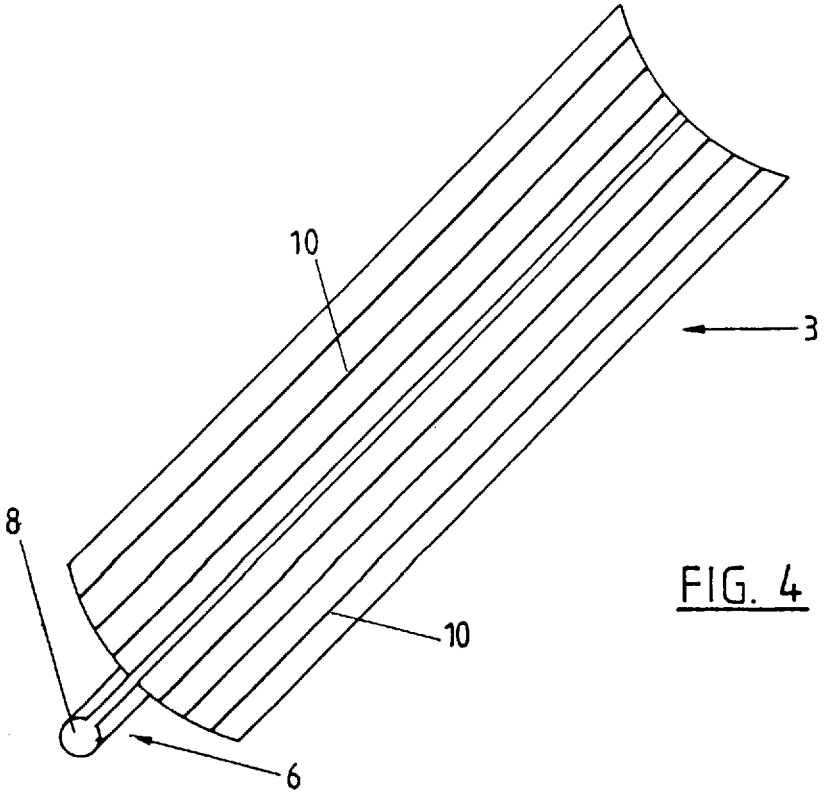
FIG. 4 is a perspective view of the elongate member.
Figure 5:
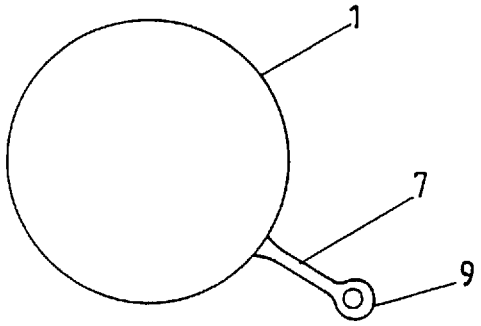
FIG. 5 is a perspective view through a pontoon.

FIG. 2 illustrates the configuration of the pontoons (1), keel (2) and elongate members (3). The substantially rigid keel (2) is secured to the elongate members (3) by welding, adhesion and/or other suitable affixing methods. FIG. 3 shows a cross-sectional view of part of the pontoon (1), part of the keel (2), and the elongate member (3). The elongate member (3) consists in cross-section of an arcuate form (4, 5) having therein a channel defining member and channel form (6). The arcuate forms (4, 5) have thereon undulating surface profiling (10) which extend longitudinally along the elongate member on the surface, between the arcuate forms (4, 5) and part of the perimeter of the pontoon (1).

The pontoon in the preferred form of the present invention has extending longitudinally at a perimeter thereof, a lip (7). Preferably the lip extends radially outwardly and preferably the lip is a beaded flexible flange. The lip (7) is slidably engageable with the channel (6) of the elongate member (3) as shown in FIG. 3. The lip (7) further contains an area of increased cross-sectional area (9) which is receivable in a retaining slot (8) in the channel (6). Shown in FIG. 3, the region of increased cross-sectional area (9) is at the distal end of the lip (7). Preferably said channel in cross-section extends radially outwardly from said pontoons. A person skilled in the art would realize that the location of the region of increased cross-sectional area (9) with respect to the lip is variable. Several regions of increased cross-sectional area (9) and corresponding retaining slots may be present in the lip (7) and elongate member (3). Preferably the slot region of increased cross-sectional area are circular in cross-section.

Figure 6:
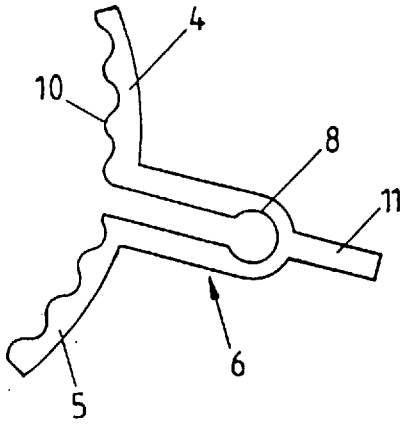
FIG. 6 is cross-sectional view of an alternative configuration of an elongate member.

The profiling on the arcuate forms (4, 5) are present thereon to break any capillary-like action between the elongate member (3) and the pontoon (1) and/or lip (7). Such capillary action may undesirably displace water into the watercraft. The profiling (10) which most preferably are ridges extending longitudinally along the member, creates regions between the arcuate forms (4, 5) and the perimeter of the pontoon past which water by capillary action, cannot pass. The elongate member 3 presents a region at which, or allows the attachment by welding, adhesion or other interconnecting methods, the connection thereof to the rigid keel form. Such a region may be a region along the channel defining region or any extension thereof. FIG. 6 illustrates an alternative configuration of the elongate member wherein an extension for attachment (11) extends from the elongate member, specifically for the fixing of the elongate member (3) to the keel (2). Preferably said member and said keel are made of a weldable metal such as aluminum or other like alloy, said member and keel welded together at said extension for attachment (11).

Figure 7:
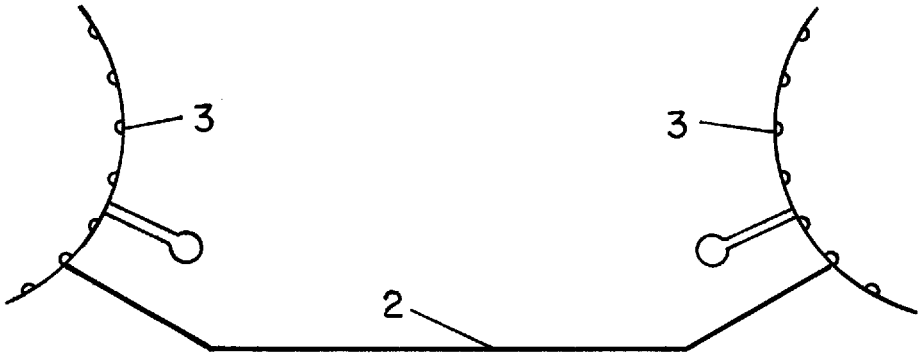
FIG. 7 is a partial cross-sectional view of two elongate members secured to a rigid keel member at a different location to that shown in FIG. 2.

If FIG. 7 there is illustrated a cross-sectional view through a keel (2) and elongate members (3) wherein the keel is secured to the elongate members at a different location to that shown in FIG. 2. It is indeed envisaged that the present invention may utilize differ point of securement of the keel (2) to each of the elongate members.

Figure 8:
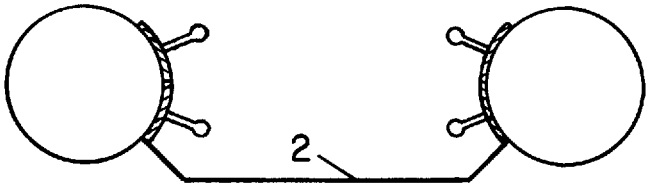
FIG. 8 is cross-sectional view through a watercraft illustrating there being two pairs of elongate members, each pair may be directly joined together or joined with the use of a space.

In FIG. 8 there is shown two pairs of elongate members, a single pair being affixed to each pontoon. The pair of elongate members may be directly jointed together or may be joined by the use of a suitable spacer or the like.

The arcuate forms have been shaped in cross-section to conform to at least of the cross-sectional perimeter of each pontoon. The channel (6) in the elongate member is most preferably located between arcuate forms (4, 5) wherein the arcuate form at or towards the inside of the water craft is longer than the arcuate form outside of the watercraft (at that side which will be in contact with water). However alternatively there may exist one part of the arcuate form area having thereon the profiling and the other part of the arcuate form on the other side of said channel with no profiling.

The elongate member extends around the perimeter of the keel, when attached to the keel, to provide a watertight securing of the keel to the surrounding pontoon/pontoons. Preferably having a transom, the elongate member will extend from the transom to the bow on each side of the keel to interconnect the keel to the pontoons.

To ensure that a close mating of the arcuate forms (4, 5) and the pontoon (1) occurs, the distance between the entrance to the channel (6) and the distance from the surface of the pontoon to the region of increased cross-sectional area (9) must substantially be equal. If these distances are not substantially equal, a loose or tight nesting between the arcuate forms (4, 5) and the pontoon (1) may occur. Both are undesirable.

Most preferably the channel defining member has one slot of substantially circular cross-section located at the distal end of the said channel. A corresponding increased cross-sectional area (9) of the lip has also a circular cross-section. The lip most preferably consists of two plies of material in between which at the distal end of said plies away from the pontoon (1), is located a rope, cable, or other device to provide a region of increased cross-sectional area.

Preferably the extension for attachment (11) is an extension of the channel defining member and extends substantially radially outwardly of therefrom, and has a surface or surfaces to which the keel (2) is capable or is welded thereto.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An elongate member to be interposed between a keel of a watercraft and a pontoon thereof, said member defining in cross-section, an arcuate form having a surface substantially conforming to at least part of a cross-sectional profile of the pontoon, a channel having a profile adapted to slidably receive a lip extending along the pontoon, wherein said elongate member includes a) an undulating profile on said surface and, b) a region for attachment to said keel.

2. The elongate member of claim 1 wherein said elongate member is an extrusion and said region for attachment consists of an extension of the extrusion.

3. The elongate member of claim 1 wherein said channel is positioned other than at an extremity of said arcuate form.

4. The elongate member of claim 1 wherein said arcuate form on the side of the channel positioned inside said watercraft is longer than an arcuate form on the side of the channel positioned outside said watercraft.

5. The elongate member of claim 1 wherein said channel extends substantially radially outwardly from said arcuate form.

6. The elongate member of claim 1 wherein said undulating profile comprises a plurality of ridges and grooves extending longitudinally along said surface.

7. The elongate member of claim 1 wherein said channel has a slot of substantially circular cross-section to receive a corresponding area of circular cross-section in the lip, said slot located at a distal end of said channel away from said arcuate form.

8. A watercraft comprising;

a keel for an inflatable craft; and an elongate member to be interposed between a keel of a watercraft and a pontoon thereof, said member defining in cross-section, an arcuate form having a surface substantially conforming to at least part of a cross-sectional profile of the pontoon, a channel to slidably receive a lip extending along the pontoon, wherein said elongate member includes a) an undulating profile on said surface and, b) a region for attachment to said keel;

said elongate member being attached said keel so as to extend outwardly from the periphery of said keel.

9. The watercraft of claim 8 further comprising pontoons attached to said elongate member.

10. A watercraft comprising:

a pair of pontoons that converge to a bow, a rigid keel, and an arcuate form extending from said keel and having a surface that substantially conforms to part of each inflated pontoon, wherein said surface includes an undulating profile in cross section.

11. The watercraft of claim 10 wherein said arcuate form is extruded.

12. The watercraft of claim 10 further comprising a channel attached to the arcuate form in a position other than at an extremity of the arcuate form, said channel extending substantially radially outwardly from said arcuate form, and adapted to slidably receive a lip extending radially from each of said pontoons.

13. The watercraft of claim 10 wherein said undulating surface comprises a plurality of ridges extending longitudinally along said arcuate form.

14. The watercraft of claim 12 wherein said channel has a slot of substantially circular cross-section to receive a corresponding area of circular cross-section in the lip, said slot located at the distal end of said channel away from said arcuate form.

15. The watercraft of claim 10 wherein said arcuate form extends from transom to bow on each side of said keel to interconnect said keel to said pontoons.

* * * * *